United States Patent [19]

Frechin

[11] 3,945,658

[45] Mar. 23, 1976

[54] SKI BINDING

[75] Inventor: Jean-Paul Frechin, Chamonix, France

[73] Assignee: Mitchell S.A., France

[22] Filed: May 22, 1975

[21] Appl. No.: 579,935

[30] Foreign Application Priority Data

May 31, 1974 France ..... 74.19126

[52] U.S. Cl. ..... 280/11.35 K; 280/11.35 N

[51] Int. Cl.[2] ..... A63C 9/08

[58] Field of Search 280/11.35 N, 11.35 C, 11.35 A, 280/11.35 T, 11.35 R

[56] References Cited

UNITED STATES PATENTS

| | | | |
|---|---|---|---|
| 3,101,201 | 8/1963 | Hall | 280/11.35 C X |
| 3,158,385 | 11/1964 | Hall | 280/11.35 A |
| 3,822,070 | 7/1974 | Salomon | 280/11.35 N |
| 3,844,575 | 10/1974 | Salomon | 280/11.35 N |

FOREIGN PATENTS OR APPLICATIONS

| | | | |
|---|---|---|---|
| 227,994 | 10/1943 | Switzerland | 280/11.35 N |
| 295,705 | 3/1954 | Switzerland | 280/11.35 N |

*Primary Examiner*—M. H. Wood, Jr.
*Assistant Examiner*—Milton L. Smith
*Attorney, Agent, or Firm*—Robert E. Burns; Emmanuel J. Lobato; Bruce L. Adams

[57] ABSTRACT

A safety ski binding has a heel grip pivoted at an end of a removable sole plate. A flexible cable tensioned by a spring winder within the sole plate serves to hold the sole plate on the ski, and simultaneously biases the heel grip to an operative boot-gripping position.

4 Claims, 3 Drawing Figures

SKI BINDING

The invention relates to ski bindings, more specifically to bindings of the type comprising a sole plate carrying a boot-sole gripping member at an end of the sole plate, means including a flexible connection and elastic biasing means tensioning said connection for holding said end of the sole plate against a ski, and means for biasing the boot-sole gripping member to an operative position for gripping a boot-sole on said plate.

In known bindings of this type sold under the Trade Mark "BURT," two distinct biasing means are provided, one for holding the sole plate against the ski, the other for holding the sole grip closed. Moreover, the tension of the spring biasing the sole grip is not adjustable, which is a disadvantage. To provide for such an adjustment, a supplementary mechanism could be added, but this may involve an increase in the volume of the sole plate.

An aim of the invention is to simplify such a binding, and avoid the mentioned inherent disadvantage.

The invention therefore provides an improvement of a binding of the stated type wherein said means for biasing the boot-sole gripping member comprise means for operatively connecting said flexible connection to a part of said member to bias said member to its operative position under the action of said elastic biasing means.

The previous separate spring for holding the sole-grip closed is hence dispensed with, and the mechanism simplified. Moreover, adjustment of the biasing force tending to hold the sole grip closed can be provided without any adjustment means, additional to those for setting release of the sole plate from the ski. The sole grip may thus usefully provide a second or reserve security release system. Finally, in the binding according to the invention, there is a substantially constant ratio between the force holding the sole plate against the ski and the force holding the sole grip closed.

Two embodiments of the invention will now be described, by way of example, with reference to the accompanying drawings, in which.

Figure 1:
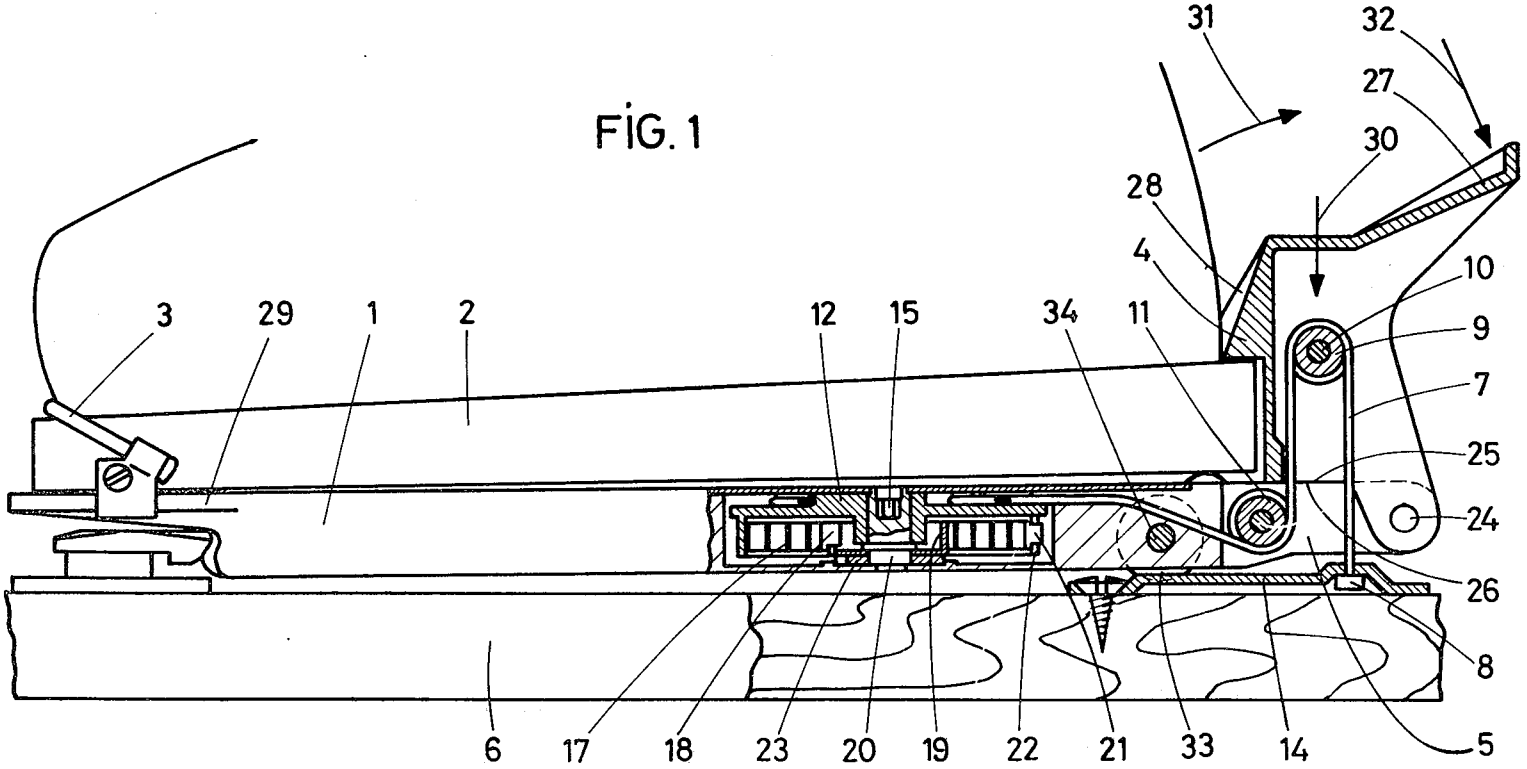
FIG. 1 is a side elevation, partly in axial cross-section, of a ski boot held on a ski by a first embodiment of binding.
Figure 2:
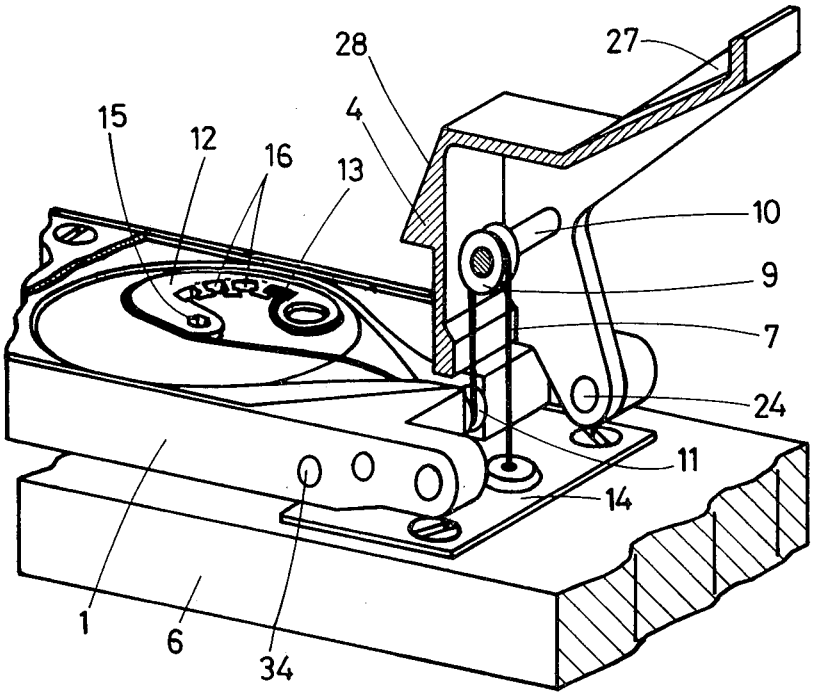
FIG. 2 is a partly cut away perspective view of this first embodiment.

The binding shown in FIGS. 1 and 2 includes a sole plate 1 on which the sole 2 of a boot can be held by a toe grip 3 and a heel grip 4 respectively carried by the front and rear ends of plate 1. The rear end 5 of plate 1 is held on a ski 6 by a flexible cable 7 having an enlarged end 8 secured to ski 6 by a securing plate 14 screwed on the ski. From this plate 14, cable 7 passes firstly over a pulley 9 pivoted on a pin 10 carried by heel-grip 4, then under a pulley 11 pivoted in plate 1, from where it passes around an outer peripheral groove in a generally C-shaped cam part of a winder 12, the cable terminating with an enlarged end 13 engaged in one of several appropriate openings in said cam part of winder 12. The cam part of winder 12 is integral with and disposed eccentrically on an upper circular face of a hollow cylindrical drum 22. The winder 12 is constantly submitted to the winding action of a spiral spring 17 whose inner end 18 is secured to a piece 19 keyed on a rotatable central shaft 20 about which the winder 12 is rotatably mounted, and whose outer end 21 is hooked in an opening in the flange of drum 22. A partially shown locking device 23 acting on shaft 20 enables the spring 17 to be held under a predetermined tension, obtained by rotating shaft 20 by engaging an Allen key in a polygonal opening 15 in the accessible upper end of shaft 20. When, as shown, the binding is in the rest position fitted on ski 6, the plate 1 bears on ski 6 via two rollers 33 which are pivoted about pins 34 in plate 1 and bear on plate 14.

The heel grip 4 is pivotally mounted about a pin 24 fixed at the rear end of plate 1, and has a flat 25 which bears against a corresponding flat upper face 26 of plate 1. Heel grip 4 also has a rear extension 27 shaped to receive the end of a ski pole for voluntary release of heel grip 4. Above the operative heel-gripping forward part of heel grip 4 is an inclined surface 28.

The front end 29 of plate 1 is held to ski 6 by an appropriate retaining device consisting of a fixed stop engaging a profile in end 29. However, the toe-end could be held by a device similar to the described heel gripping arrangement.

In use, the tension of spring 17 is set by rotating shaft 20 by its opening 15 to provide an appropriate release setting. Whatever be the setting, plate 1 always tends to be held against ski 6 by spring 17 by the intermediary of cable 7 which always remains taut, whether the binding is at rest (closed) or released (open). Spring 17, by cable 7, constantly acts on pulley 9 as indicated by arrow 30 to tend to hold the flat 25 of heel grip 4 against face 26 of plate 1, in which position the heel of a boot sole 2 may be held against plate 1. The sole 2 is placed on plate 1 by pressing the heel against inclined surface 28. This produces a momentaneous tipping of heel grip 4 about its pin 24, as indicated by arrow 31, the heel grip 4 automatically springing back to the position of FIG. 1 as soon as the sole 2 is correctly in place. When desired, the boot sole 2 may be removed from plate 1 by acting on extension 27 with a ski pole, as indicated by arrow 32, to produce a similar tipping of heel grip 4 sufficient to free the heel. This tipping of heel grip 4 during insertion or removal of a boot takes place against the action of spring 17 which is momentaneously further compressed.

As a variation (not shown) of the first embodiment, the end 8 of cable 7 is fixed to heel grip 4 instead of being fixed to plate 14. The cable 7 passes under a pulley 9 which, instead of being carried by grip 4 is carried by plate 14, then over (instead of under) pulley 17, and is attached to winder 12 as before. The other elements of such a variation are identical to those described previously, and operation is the same.

Figure 3:
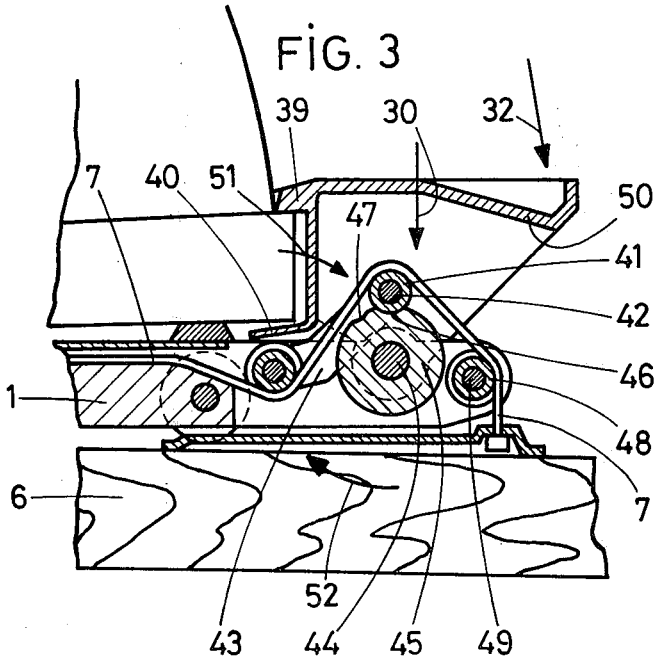
FIG. 3 is a partial view similar to FIG. 1 of a second embodiment.

In FIG. 3, showing the second embodiment, the same reference numerals are used for the same elements. In this embodiment, the inclined surface 28 is dispensed with, but the heel grip, designated by 39, is provided with a lower projecting lip 40 to enable fitting of a boot. The previous pulley 9 is replaced by a pulley or roller 41 pivoted on a pin 42 carried by a lever 45 pivotally mounted on plate 1. Heel-grip 39 is pivoted on plate 1 about a pin 44. A cam 45 is fixed for rotation with heel grip 4 concentric to pin 44. At its periphery, cam 45 has two notches 46 and 47 which receive roller 41. The cable 7 passes about an extra pulley 48 pivoted on a pin 49 fixed on plate 1. Heel-grip 39 has an extension 50. All of the other elements are identical to those of the first embodiment, and will be referred to by the same references.

In operation, as before, spring 17 acts on cable 7 to constantly exert a force on roller 41 according to arrow 30 whereby roller 41 and lever 43 are pivoted as indicated by arrow 51 against cam 45. When the binding is "closed" as in FIG. 3, roller 41 engages in notch 46 of cam 45 and the sole 2 is thus held against plate 1 by grip 39. The heel grip 39 is tipped to an open position, to allow insertion of a boot heel or removal of a secured boot heel, by acting on extension 50 with a ski pole, as per arrow 32. Cam 45 is thus rotated as indicated by arrow 52, and roller 41 is pushed up by the profile of cam 45 until it drops into notch 47. The heel grip 39 is held in this open position by cable 7 under the action of spring 17. When a boot sole 2 is inserted in the binding, it acts on lip 40 according to arrow 30, and drives grip 39 back to its rest or closed position shown in FIG. 3.

In a variation, not shown, of this second embodiment, the roller 41 instead of being carried by lever 43 is guided in a slot in a flange on plate 1.

In another variation, not shown, of the second embodiment, the roller 41, instead of being carried by lever 43 pivoted on plate 1, is guided in a slot in the sole grip 39, and the cam 45 is carried by the rear of the plate 1, instead of by grip 39.

The other elements of these two variations are the same as for the second embodiment, and operation is similar, the roller 41 cooperating with notch 46 or 47 of cam 45 to hold the heel grip 39 respectively in the closed or open position.

The described heel-grips 4 and 9 have voluntary opening means for actuation by a ski pole, for example. These heel grips could have elements arranged to enable them to open and free the boot sole in the event of a violent stress. Such a use as a second or double security system (the main security being provided by cable 7 and spring 17 which allow plate 1 to be pulled away from the ski) is possible since the biasing force holding the sole grip in closed position can be adjusted. In fact, there is a substantially constant ratio between this force and the force tending to hold plate 1 on ski 6. Regulation of the latter force, by turning shaft 20, hence sets the former force in a similar proportion.

Instead of being pivoted, the sole grips could be slidably mounted on plate 1.

Also, the elastic biasing means (spring 17) for cable 7 could be arranged on the upper face of the ski, instead of in plate 1. Other elastic biasing means could be provided, cooperating with a winder, as described, or with other means for allowing withdrawal of the cable. Such sole grips may be provided solely at the heel end or toe end of a boot, or at both ends.

It is of course understood that the terms cable and flexible connection as used herein are meant to include all suitable flexible strands, cords, wires and other substantially non-extensible flexible elongate members.

What is claimed is:

1. In a safety ski binding comprising a sole plate carrying a boot-sole gripping member at an end of the sole plate, means including a flexible connection and elastic biasing means tensioning said connection for holding said end of the sole plate against a ski, and means for biasing the boot-sole gripping member to an operative position for gripping a boot sole on said plate, the improvement wherein said means for biasing the boot-sole gripping member comprise means for operatively connecting said flexible connection to a part of said member to bias said member to its operative position under the action of said elastic biasing means.

2. A binding according to claim 1, comprising means securing an end of said flexible connection to the ski, said part of the boot-sole gripping member being a pulley pivotally mounted on the boot-sole gripping member, said flexible connection passing about said pulley.

3. A binding according to claim 1, comprising means securing an end of said flexible connection to the ski, and a roller movably mounted on said sole plate, said flexible connection passing about said roller to urge said roller against said part of the boot sole gripping member, and means defining a profile in said part of said boot-sole gripping member for engagement with said roller to define two stable positions of the boot-sole gripping member.

4. A binding according to claim 3, in which said boot-sole gripping member is pivotally mounted on said base plate about an axis, said part being a generally circular cam coaxial to said axis with means defining two recesses in its periphery for engagement with said roller.

* * * * *